US007343886B2

(12) United States Patent
Miura

(10) Patent No.: US 7,343,886 B2
(45) Date of Patent: Mar. 18, 2008

(54) INTERNAL COMBUSTION ENGINE CONTROL APPARATUS

(75) Inventor: Hajime Miura, Tama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/684,768

(22) Filed: Mar. 12, 2007

(65) Prior Publication Data

US 2007/0215105 A1 Sep. 20, 2007

(30) Foreign Application Priority Data

Mar. 15, 2006 (JP) ..... 2006-070229
Mar. 5, 2007 (JP) ..... 2007-053587

(51) Int. Cl.
*F01L 9/02* (2006.01)

(52) U.S. Cl. ..... 123/90.12; 123/90.15; 123/339.24

(58) Field of Classification Search .. 123/90.15–90.18, 123/90.12, 339.24
See application file for complete search history.

(56) References Cited

U.S. PATENT DOCUMENTS 5,529,031 A 6/1996 Yoshioka
5,558,051 A 9/1996 Yoshioka
6,109,225 A * 8/2000 Ogita et al. ..... 123/90.15
6,530,351 B2 * 3/2003 Mikame ..... 123/90.15
6,959,692 B2 * 11/2005 Song et al. ..... 123/90.15
7,168,410 B2 * 1/2007 Kato et al. ..... 123/339.15
7,210,450 B2 * 5/2007 Arinaga et al. ..... 123/339.19
2004/0112331 A1 6/2004 Miura
2006/0086338 A1 * 4/2006 Kato et al ..... 123/339.15

FOREIGN PATENT DOCUMENTS

EP 0 859 130 A1 8/1998
JP 11-107725 4/1999
JP 2004-197566 7/2004

* cited by examiner

*Primary Examiner*—Erick Solis
(74) *Attorney, Agent, or Firm*—Global IP Counselors, LLP

(57) ABSTRACT

An internal combustion engine control apparatus is provided with a hydraulically operated variable valve operating mechanism for varying the valve timing of air intake valves, and a water temperature sensor for sensing engine coolant temperature to estimate the degree of engine warm-up. The valve operating mechanism is controlled to switch the valve timing from the warm-up idle valve timing with a high idling speed to the post-warm-up idle valve timing with a slower idling speed as the engine temperature approaches the warm-up temperature threshold. The switch in valve timings starts before an engine rotational speed falls below a rotational speed threshold lying between the high idling speed during the warm-up idling and the post-warm-up idling speed during the post-warm-up idling such that a sufficient hydraulic pressure switch the valve timing with a specific degree of responsiveness is attained when the engine rotational speed is at or above the rotational speed threshold.

10 Claims, 6 Drawing Sheets

INTERNAL COMBUSTION ENGINE CONTROL APPARATUS

CROSS-REFERENCE TO RELATED APPLICATIONS

This application claims priority to Japanese Patent Application No. 2006-070229, filed on Mar. 15, 2006, and Japanese Patent Application No. 2007-053587, filed on Mar. 5, 2007. The entire disclosures of Japanese Patent Application No. 2006-070229 and Japanese Patent Application No. 2007-053587 are hereby incorporated herein by reference.

BACKGROUND OF THE INVENTION

1. Field of the Invention

The present invention generally relates to an internal combustion engine control apparatus. More specifically, the present invention relates to a control apparatus that changes the valve timing of air intake valves from a warm-up idle valve timing to the post-warm-up idle valve timing.

2. Background Information

Japanese Patent Application Laid-Open No. 11-107725 discloses an internal combustion engine comprising a hydraulically operated phase varying mechanism that can vary the valve timing of the air intake valve by delaying the phase of the lift center angle.

In view of the above mentioned conventional technology, it will be apparent to those skilled in the art from this disclosure that there exists a need for an improved control apparatus. This invention addresses this need in the art as well as other needs, which will become apparent to those skilled in the art from this disclosure.

SUMMARY OF THE INVENTION

It has been discovered that in an internal combustion engine having a hydraulic phase varying mechanism, the phase of the lift center angle can be optimally set according to driving conditions, but at low-speed rotations such as idle driving conditions following warm-up, it is difficult to obtain the hydraulic pressure needed to operate the phase varying mechanism in a normal manner, and responsiveness is reduced.

In accordance with one aspect of the present invention, an internal combustion engine control apparatus is provided that basically comprises a hydraulically operated variable valve operating mechanism and a valve timing control section. The hydraulically operated variable valve operating mechanism is configured to vary a valve timing of air intake valves. The valve timing control section is configured to control the hydraulically operated variable valve operating mechanism to set the valve timing to a warm-up idle valve timing with a high idling speed when engine temperature is determined to be cold and to set the valve timing to a post-warm-up idle valve timing with a post-warm-up idling speed when the engine temperature is determined to be equal to or above a warm-up temperature threshold, the high idling speed being higher than the post-warm-up idling speed. The valve timing control section is further configured to switch the valve timing from the warm-up idle valve timing to the post-warm-up idle valve timing as the engine temperature approaches the warm-up temperature threshold such that the switch starts before an engine rotational speed is determined to fall below a rotational speed threshold lying between the high idling speed during the warm-up idle valve timing and the post-warm-up idling speed during the post-warm-up idle valve timing such that a sufficient hydraulic pressure switch the valve timing with a specific degree of responsiveness is attained when the engine rotational speed is at or above the rotational speed threshold.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
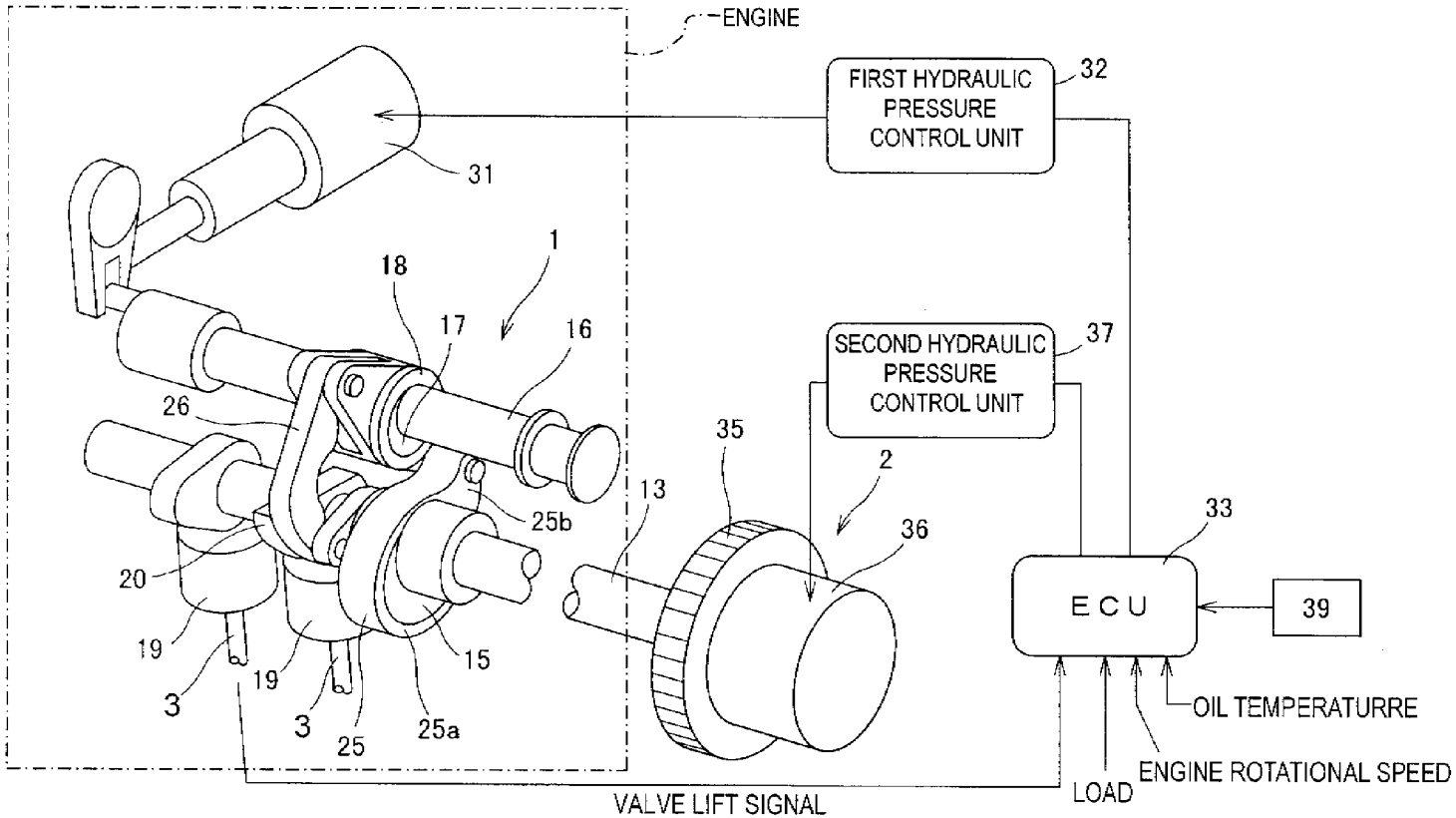
FIG. 1 is a diagrammatic perspective view illustrating key components of a variable valve operating mechanism of an intake control apparatus for the internal combustion engine in accordance with a preferred present invention.

Referring initially to FIG. 1, a system configuration of an internal combustion engine control apparatus for an internal combustion engine is illustrated as one example or embodiment of the present invention. This internal combustion engine control apparatus has a hydraulically operated variable valve operating mechanism that basically includes a lift/operating angle varying mechanism 1 and a hydraulically-operated phase varying mechanism 2. The internal combustion engine is a spark ignition gasoline engine that has a plurality of cylinders with a plurality of intake valves 3 (only two intake valves 3 are shown) and a plurality of exhaust valves (not shown). The intake valves 3 are operatively coupled to the variable valve operating mechanism that serves as a valve operating mechanism. The variable valve operating mechanism is configured and arranged to change a valve lift characteristic of the intake valves 3. The valve lift characteristic of the intake valves 3 includes, but is not limited to, a valve lift of the intake valves 3, a duration (operating angle) of the intake valves 3 and the phase of the lift center angle of the intake valves 3. In particular, the lift/operating angle varying mechanism 1 is configured and arranged to vary the lift/operating angles of air intake valves 3. The hydraulically-operated phase varying mechanism 2 is configured and arranged to advance or retard (delay) the phase of the lift center angle (i.e., the phase in relation to a crankshaft that is not shown).

First, the lift/operating angle varying mechanism 1 will be described, also with reference to the operation diagram in FIG. 2. This lift/operating angle varying mechanism 1, for example, has already been disclosed in U.S. Pat. No. 6,843,226. Therefore, the lift/operating angle varying mechanism 1 will only be briefly described herein.

The lift/operating angle varying mechanism 1 basically includes a hollow drive shaft 13, an eccentric cam 15, a control shaft 16, an eccentric cam part 17, a rocker arm 18, and a rocking cam 20. Of course, it will be apparent to one skilled in the art from this disclosure that the air intake valves 3 of each of the cylinders are operated in a similar manner. The hollow drive shaft 13 is rotatably supported on a cam bracket (not shown) at the top of a cylinder head (not shown). The eccentric cam 15 is fixed to the drive shaft 13 by press-fitting or the like. The control shaft 16 is rotatably supported by the cam bracket (not shown) above the drive shaft 13. The control shaft 16 is disposed parallel to the drive shaft 13. The eccentric cam part 17 is fixedly coupled to the control shaft 16 and movably supports the rocker arm 18 so that the rocker arm 18 can rock freely. In other words, the rocker arm 18 is oscillatably supported on the control shaft 16 by the eccentric cam part 17. The rocking cam 20 is arranged in contact with one of two tappets 19. The tappets 19 are located on the upper ends of the intake valves 3. The eccentric cam 15 and the rocker arm 18 are linked by a link arm 25, while the rocker arm 18 and the rocking cam 20 are linked by a link member 26. The eccentric cam part 17 is eccentric with respect to the center axis of the control shaft 16. As a result, the rocking center (fulcrum) of the rocker arm 18 changes in accordance with the angular position of the control shaft 16. The crankshaft of the engine drives the drive shaft 13 via a timing chain or a timing belt.

The eccentric cam 15 has a circular external peripheral surface. The center of the external peripheral surface is offset a specific distance from the axial center of the drive shaft 13, and an annular part 25*a* of the link arm 25 is rotatably fitted over this external peripheral surface.

The middle of the rocker arm 18 is supported by the eccentric cam part 17. An elongated part 25*b* of the link arm 25 is linked to one end of the rocker arm 18, and the upper end of the link member 26 is linked to the other end of the rocker arm 18. The eccentric cam part 17 is eccentric relative to the axial center of the control shaft 16, and the center of oscillation of the rocker arm 18 therefore varies according to the angle position of the control shaft 16.

Figure 2A:
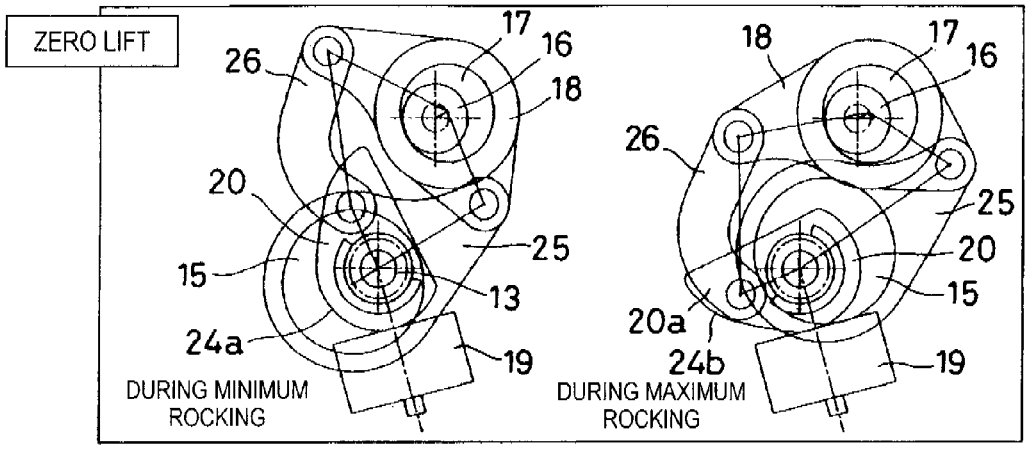
FIG. 2(A) is a diagrammatic operation diagram illustrating a zero lift operation of a lift/operating angle varying mechanism of the variable valve operating mechanism in accordance with the preferred embodiment of the present invention.
Figure 2B:
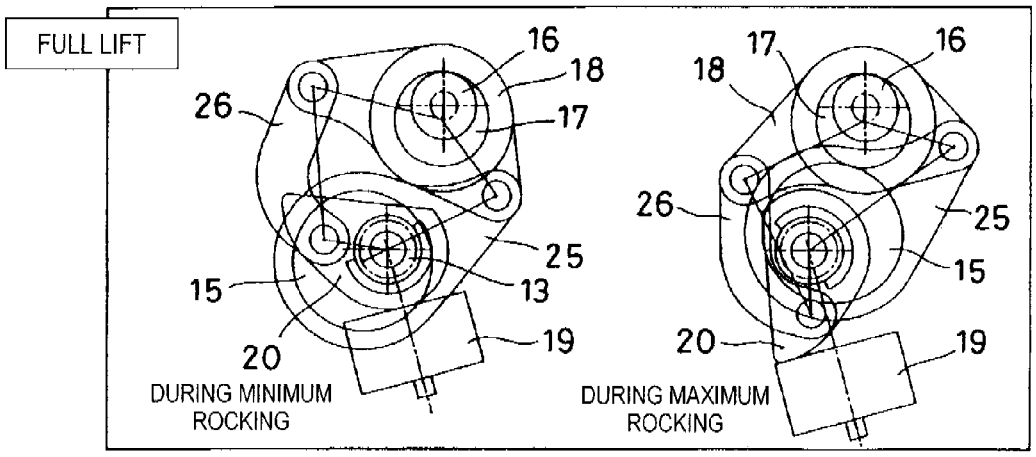
FIG. 2(B) is a diagrammatic view operation diagram illustrating a full lift operation of the lift/operating angle varying mechanism of the variable valve operating mechanism in accordance with the preferred embodiment of the present invention.

The rocking cam 20 is configured and arranged to be movably mounted on the outer surface of the drive shaft 13 and is supported thereon such that the rocking cams 20 can rotate freely relative to the drive shaft 13. The rocking cams 20 include outwardly (laterally) extended end part 20*a* that are linked to the lower end of the link member 26. The bottom surface of the rocking cam 20 has a circular base surface 24*a* forming a circular arc that is concentric with respect to the drive shaft 13 and a cam surface 24*b* that extends along a prescribed curve from the circular base surface 24*a* to the end part 20*a*. The transition surface between the circular base surface 24*a* and the cam surface 24*b* is smooth. The circular base surface 24*a* contacts the tappet 19 when the lift amount is zero, as shown in FIG. 2(A). The lift amount increase gradually as the rocking cam 20 turns and the cam surface 24*b* contacts the tappet 19 as shown in FIG. 2(B). Thus, the circular base surface 24*a* and the cam surface 24*b* are designed to come into contact with the top surface of the tappet 19 in accordance with the oscillating or rocking position of the rocking cam 20. Specifically, the circular base surface 24*a* is a base circle section where the amount of lift is 0, and the cam surface 24*b* is a lift section. The circular base surface 24*a* is gradually lifted when the rocking cam 20 rocks or oscillates and then the cam surface 24*b* comes into contact with the tappet 19, as shown in FIG. 2(B). A small ramp section is provided between the base circle section and a lift section.

The rotational position of the control shaft 16 is controlled with, for example, a lift/operating angle control hydraulic actuator 31. The lift/operating angle control hydraulic actuator 31 is preferably provided at one end of the control shaft 16 as shown in FIG. 1. A first hydraulic pressure control unit 32 controls the supply of hydraulic pressure to the lift/operating angle control hydraulic actuator 31, on the basis of a control signal from an engine control unit 33.

The engine control unit 33 preferably includes a microcomputer with a control program that controls the amount of the intake air as discussed below. The engine control unit 33 also includes other conventional components such as an input interface circuit, an output interface circuit, and storage devices such as a ROM (Read Only Memory) device and a RAM (Random Access Memory) device. The microcomputer of the engine control unit 33 is programmed to control the amount of the intake air. The memory circuit stores processing results and control programs that are run by the processor circuit. The engine control unit 33 is operatively coupled to the other components of the intake control apparatus for internal combustion engine in a conventional manner. The internal RAM of the engine control unit 19 stores statuses of operational flags and various control data. The engine control unit 33 is capable of selectively controlling any of the components of the control system of the intake control apparatus for internal combustion engine in accordance with the control program. It will be apparent to those skilled in the art from this disclosure that the precise structure and algorithms for the engine control unit 33 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

Accordingly, in the intake control apparatus of the present invention, the engine control unit 33 is configured and arranged to control the valve lift characteristic of the intake valves 3 such that the amount of intake air drawn into the cylinders reaches a target intake air amount that is set according to the operating conditions of the internal combustion engine.

With the internal combustion engine control apparatus, the engine control unit 33 constitutes a valve timing control section that is configured to control the hydraulically operated variable valve operating mechanism to set the valve timing to a warm-up idle valve timing with a high idling speed when engine temperature is determined to be cold and to set the valve timing to a post-warm-up idle valve timing with a post-warm-up idling speed when the engine temperature is determined to be equal to or above a warm-up temperature threshold. The high idling speed of the warm-up idle valve timing is higher than the post-warm-up idling speed of the post-warm-up idle valve timing. The valve timing control section is further configured to switch the valve timing from the warm-up idle valve timing to the post-warm-up idle valve timing as the engine temperature approaches the warm-up temperature threshold such that the switch starts before an engine rotational speed is determined to fall below a rotational speed threshold lying between the high idling speed during the warm-up idle valve timing and the post-warm-up idling speed during the post-warm-up idle valve timing. Thus, a sufficient hydraulic pressure switch the valve timing with a specific degree of responsiveness is attained when the engine rotational speed is at or above the rotational speed threshold. In other words, it is possible to rapidly switch from warm-up idle valve timing to post-warm-up idle valve timing, and to improve fuel consumption in an internal combustion engine, because the variable valve operating mechanism is operated when the operating hydraulic pressure is high. Also, the extent to which switching from the warm-up idle valve timing to the post-warm-up idle valve timing has an effect on operability (combustion stability) can be greatly reduced because the switching takes place at the final phase of fast idling.

A signal from a coolant temperature sensor 39 is inputted to the engine control unit 33. This coolant temperature sensor 39 is a coolant temperature sensing device for sensing the temperature of coolant in the internal combustion engine. The coolant temperature sensor 39 is used to estimate the degree in which the engine has warmed up. Thus, the coolant temperature sensor 39 is used to determine when the temperature of the engine is equal to or above a warm-up temperature threshold T1 (see FIG. 9). Signals from engine rotational speed, engine load, temperature, and so on are also inputted to the engine control unit 33.

The following is a description of the action of the lift/operating angle varying mechanism 1. When the drive shaft 13 rotates, the link arm 25 moves up and down due to the cam action of the eccentric cam 15, and the rocker arm 18 rocks accordingly. The oscillation or rocking of the rocker arm 18 is transmitted to the rocking cam 20 via the link member 26, and the rocking cam 20 oscillates or rocks. The cam action of the rocking cam 20 pushes on the tappet 19 and lifts the air intake valve 3.

When the lift/operating angle control hydraulic actuator 31 changes the angle of the control shaft 16, the initial position of the rocker arm 18 changes, and consequently the initial oscillating position of the rocking cam 20 changes as well.

When the eccentric cam part 17 is at the top position as shown in FIG. 2(A), for example, the entire rocker arm 18 is also at the top position, and the end part 20*a* of the rocking cam 20 is pulled upward in relative fashion. In other words, the initial position of the rocking cam 20 is inclined so that the cam surface 24*b* is separated from the tappet 19. Therefore, when the rocking cam 20 oscillates along with the rotation of the drive shaft 13, the circular base surface 24*a* continues to contact the tappet 19 for a long period of time, and the cam surface 24*b* contacts the tappet 19 for only a brief time. Therefore, the amount of lift as a whole is reduced, and the angle range, i.e., the operating angle (duration) from the opening point to the closing point, is reduced.

Conversely, when the eccentric cam part 17 is at the bottom position as shown in FIG. 2(B), the entire rocker arm 18 is at the bottom position, and the end part 20*a* of the rocking cam 20 is pushed downward in relative fashion. In other words, the initial position of the rocking cam 20 causes the cam surface 24*b* to be inclined towards the tappet 19. Therefore, when the rocking cam 20 oscillates along with the rotation of the drive shaft 13, contact with the tappet 19 is immediately transferred from the circular base surface 24*a* to the cam surface 24*b*. Therefore, the entire amount of lift increases, and the operating angle (duration) is also enlarged.

Figure 3:
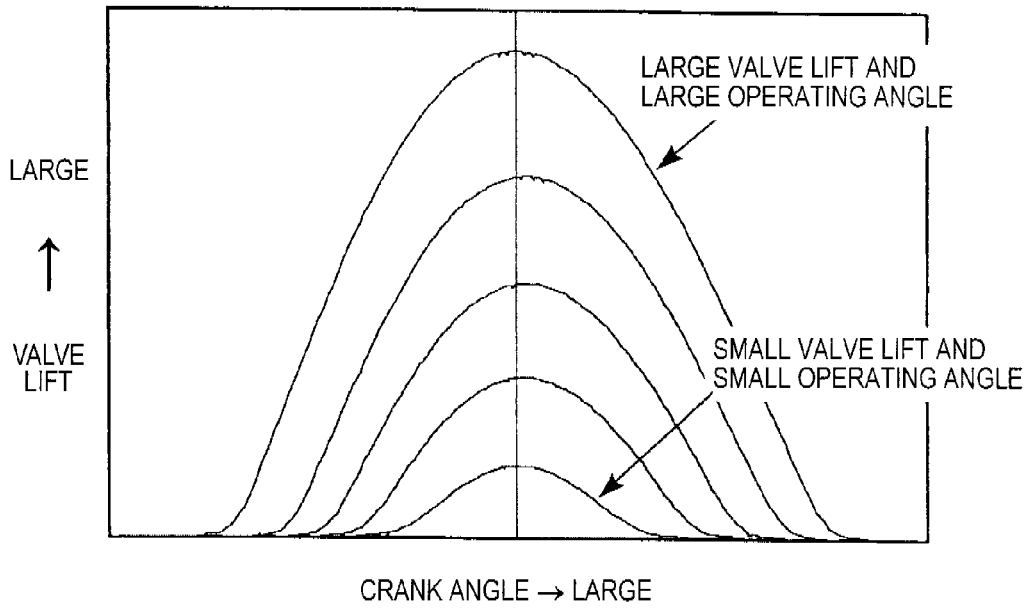
FIG. 3 is a characteristic diagram showing the characteristic changes of the lift/operating angle (i.e., lift and duration of air intake valves) made by the lift/operating angle varying mechanism in accordance with the preferred embodiment of the present invention.

Since the initial position of the eccentric cam part 17 changes continuously, the valve lift characteristics also change continuously as shown in FIG. 3. In other words, the lift and the operating angle can both be continually increased and reduced at the same time. In this embodiment, the opening time and closing time of the air intake valves 3 change in a substantially symmetrical manner along with changes in the magnitude of the lift/operating angle.

Figure 4:
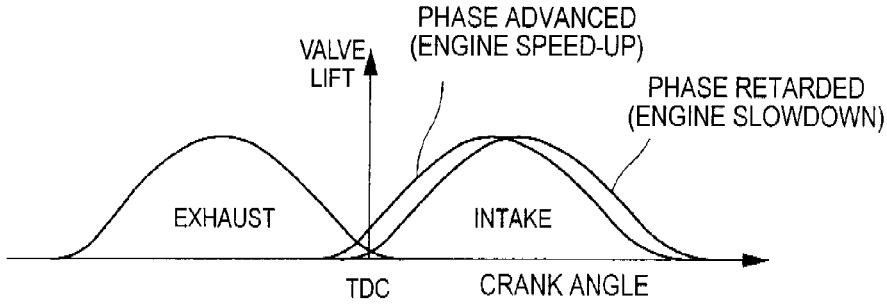
FIG. 4 is a timing characteristic diagram showing the phase changes in the valve lift characteristics made by the phase varying mechanism in accordance with the preferred embodiment of the present invention.

Referring back to FIG. 1, the hydraulically-operated phase varying mechanism 2 of the variable valve operating mechanism is now described in more detail. The hydraulically-operated phase varying mechanism 2 basically comprises a sprocket 35 and a phase control hydraulic actuator 36. The sprocket 35 is provided at the front end of the drive shaft 13. The phase control hydraulic actuator 36 rotates the sprocket 35 and the drive shaft 13 relative to each other within a specific angle range, as shown in FIG. 1. The sprocket 35 is linked to a crankshaft via a timing chain or a timing belt (not shown). A second hydraulic pressure control unit 37 controls the supply of hydraulic pressure to the phase control hydraulic actuator 36, on the basis of a control signal from the engine control unit 33. The control of hydraulic pressure to the phase control hydraulic actuator 36 causes the sprocket 35 and the drive shaft 13 to rotate relative to each other, and retards the lift center angle as shown in FIG. 4. In other words, the curve of the lift characteristics does not change, but the lift characteristics are either advanced or retarded (delayed). This change can be achieved continuously.

To control the lift/operating angle varying mechanism 1 as well as the hydraulically-operated phase varying mechanism 2, a sensor is provided to detect the lift/operating angle or the phase, and either closed loop control or merely open loop control can be used in accordance with the operating conditions.

Figure 5:
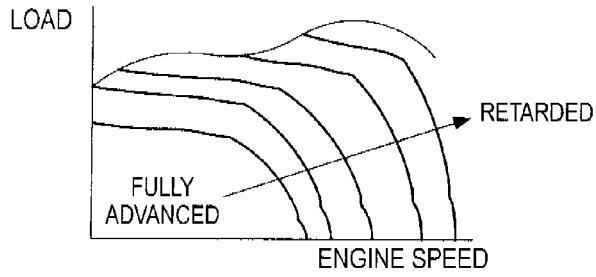
FIG. 5 is a map for calculating the phase of the lift center angle of the air intake valves determined according to load and engine rotational speed in accordance with the preferred embodiment of the present invention.

In the internal combustion engine equipped with the variable valve operating mechanism described above, when the engine temperature is cold (below a prescribed temperature threshold), the throttle is set to obtain a high idling speed during a fast idling state at the start of the cold engine period. This high idling speed is set to be higher than the idling speed during post-warm-up idling after the engine temperature has risen above a prescribed temperature threshold. The valve timing of the air intake valves 3 is designed with consideration to fuel consumption performance. As seen in FIG. 5, the phase of the lift center angle is advanced at small engine loads and low rotational engine rotational speeds, and the phase of the lift center angle is retarded in accordance with increases in the rotational engine rotational speed and/or the engine load.

Figure 6:
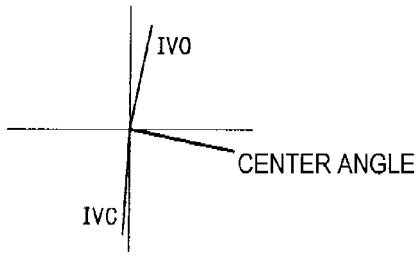
FIG. 6 is a diagram schematically showing the valve timing of the air intake valves during the fast idling state in accordance with the preferred embodiment of the present invention.

In the present embodiment, the valve timing of the air intake valves 3 during the fast idling state is established with emphasis on emission performance and combustion stability. Thus, the lift/operating angle of the air intake valves 3 is set so that the phase of the lift center angle is retarded (delayed) in relative terms to bottom dead center with an increased lift and/or increased operating angle (duration), as shown in FIG. 6.

Figure 7:
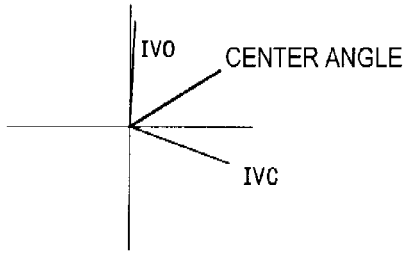
FIG. 7 is a diagram schematically showing the valve timing of the air intake valves during the post-warm-up idling state in accordance with the preferred embodiment of the present invention.
Figure 8:
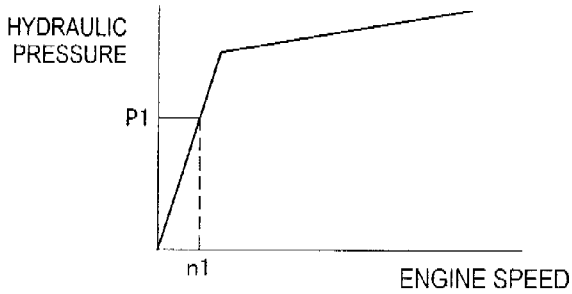
FIG. 8 is a characteristic diagram showing the correlating relationship between engine rotational speed and hydraulic pressure in accordance with the preferred embodiment of the present invention.

The valve timing of the air intake valves 3 during the post-warm-up idling state is established with emphasis on fuel consumption performance. Thus, the lift/operating angle of the air intake valves 3 is set so that the phase of the lift center angle is advanced at the top dead center with a smaller lift and/or smaller operating angle (duration) than the valve timing of the air intake valves 3 during the fast idling state, as shown in FIG. 7.

An oil pump (not shown) in the present embodiment has the characteristic of increasing hydraulic pressure in accordance with the engine rotational speed. Such a pump is used because when the flow quantity in the hydraulic pump is increased to ensure that sufficient hydraulic pressure is reliably obtained, it is possible that friction will increase and affect fuel consumption performance, even when the engine rotational speed is low.

In the present embodiment, when the drive state changes from fast idling at the start of cold ending period to post-warm-up idling, the hydraulically-operated phase varying mechanism 2 switches the valve timing of the air intake valves 3 to the valve timing of the post-warm-up idling state while still in the fast idling state having a high engine rotational speed; i.e., while hydraulic pressure is high. In other words, the hydraulically-operated phase varying mechanism 2 advances the phase of the lift center angle of the air intake valves 3 from the lift center angle phase of the fast idling state to the lift center angle phase of the post-warm-up idling state while the hydraulic pressure is high.

Figure 10:
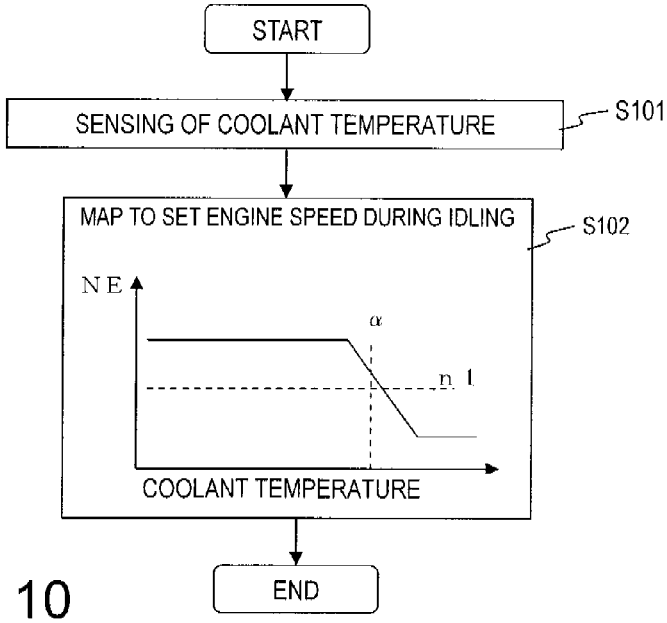
FIG. 10 is a flowchart showing the setting of the engine rotational speed during idling based on the coolant temperature of the engine in accordance with the preferred embodiment of the present invention.

The procedure for implementing this type of control will now be described using the flowcharts shown in FIGS. 10 and 11. FIG. 10 is a flowchart showing the setting of the engine rotational speed during fast idling in accordance with the temperature of coolant in the engine. This flowchart is repeated at specific intervals.

First, the temperature of coolant in the engine is sensed based on a sensor signal from a coolant temperature sensor (not shown) in step S101.

Next, the process advances to step S102, and the engine rotational speed corresponding to the coolant temperature sensed in step S101 is set based on the map for setting engine rotational speed during fast idling shown in step S102. In this map, the engine rotational speed during idling is set high when the coolant temperature in the engine is low. When the coolant temperature in the engine increases and approaches the warm-up temperature, the engine rotational speed is rapidly set to the post-warm-up engine rotational speed in accordance with the increase in coolant temperature.

Figure 9:
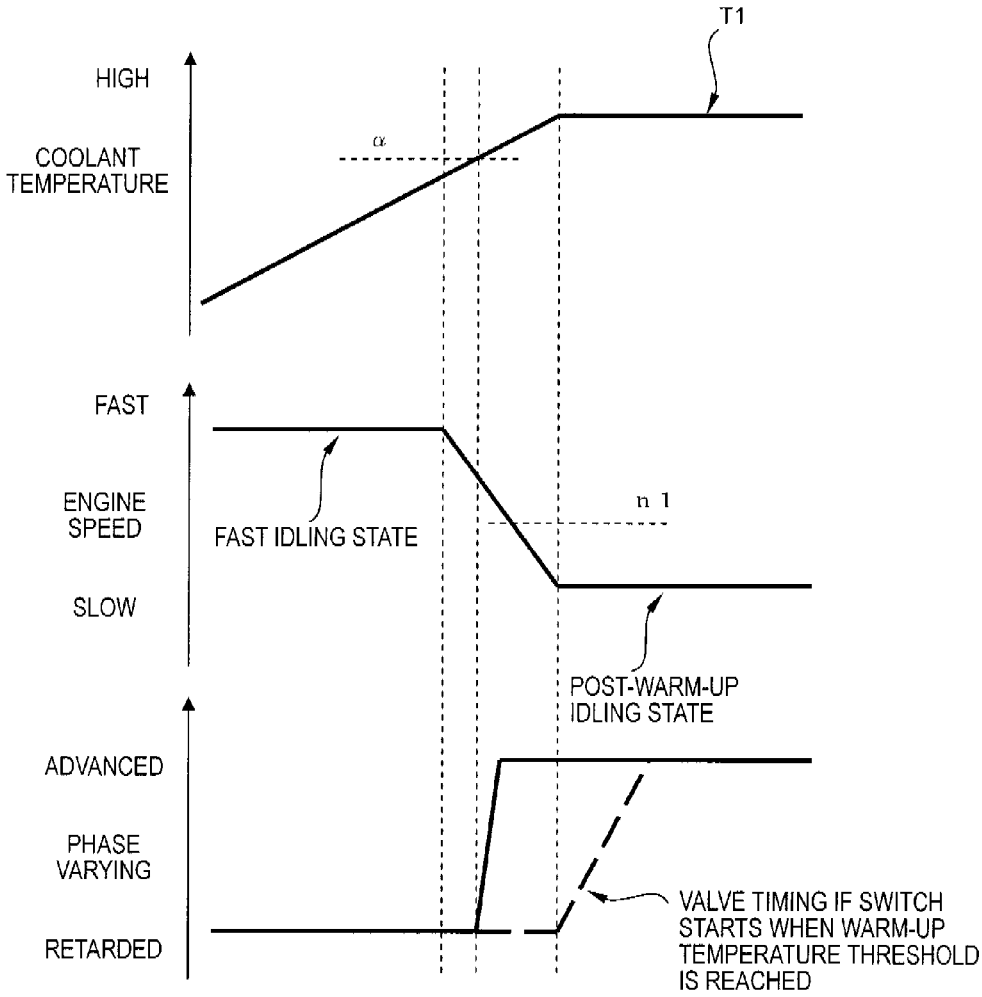
FIG. 9 is a timing chart depicting a case in which the valve timings of the air intake valves are switched from the fast idling state to valve timings for the post-warm-up idling state in accordance with the preferred embodiment of the present invention.

The engine rotational speed threshold n1 shown in the maps of FIGS. 9 and 10 is an engine rotational speed threshold that is required to provide the hydraulic pressure needed by the hydraulically-operated phase varying mechanism 2 to switch the valve timing of the air intake valves 3 from the valve timing of the fast idling state to the valve timing of the post-warm-up idling state with high responsiveness. The comparative value a of the coolant temperature of the engine shown in the maps of FIGS. 9 and 10 is the coolant temperature that guarantees that the valve timing will be completely switched before the engine rotational speed falls below the engine rotational speed threshold n1, provided the valve timing is switched when the coolant temperature in the engine reaches the comparative value a. In the present embodiment, the switching of the valve timing when the coolant temperature reaches the comparative value $\alpha$ ensures that the valve timing will be completely switched before the engine rotational speed falls below the engine rotational speed threshold n1 that guarantees hydraulic pressure.

Figure 11:
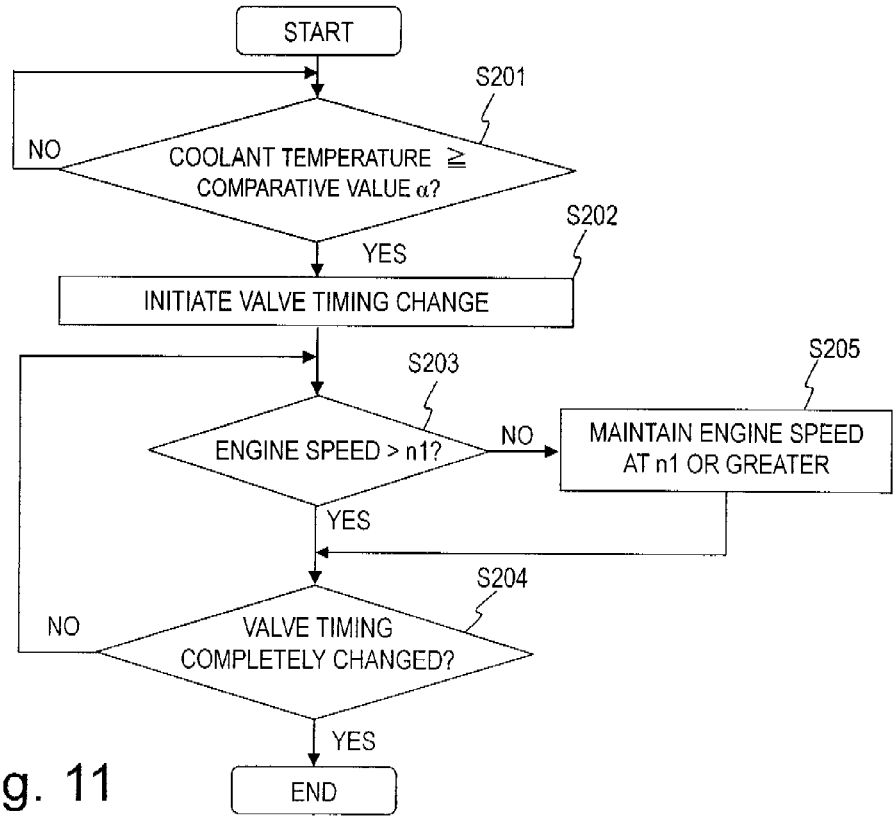
FIG. 11 is a flowchart describing the switching of the valve timing of the air intake valves at the end of the fast idling phase ahead of the timing at which a switch is made from the fast idling state to the post-warm-up idling state in accordance with the preferred embodiment of the present invention.

The procedure for this type of control is described using the flowchart in FIG. 11. This flowchart is also repeated at specific intervals, similar to FIG. 10.

First, in step S201, a determination is made as to whether the coolant temperature in the engine is greater than the comparative value $\alpha$. In cases in which the coolant temperature in the engine is less than the comparative value $\alpha$, the system remains in standby mode without change until the coolant temperature in the engine falls below the comparative value $\alpha$.

The coolant temperature in the engine increases along with the warm-up operation, and when the temperature reaches the comparative value $\alpha$, the process advances to step S202. In step S202, the valve timing switching is initiated, and the process advances to step S203.

In step S203, a determination is made as to whether the engine rotational speed (rpm) is less than the engine rotational speed threshold n1 that guarantees the hydraulic pressure needed to switch the valve timing with high responsiveness. In cases in which the engine rotational speed is greater than the engine rotational speed threshold n1, the process advances to step S204.

In step S204, a determination is made as to whether the valve timing has been completely changed. If the valve timing has not been completely changed, the process returns to step S203 and the valve timing continues to change. If the valve timing has been completely changed, the process in this flowchart is ended.

In cases in which it is determined in step S203 that the engine rotational speed has fallen below n1 while the valve timing is being switched, the responsiveness of changing the valve timing is reduced if the engine rotational speed decreases. Therefore, the process advances to step S205, the system maintains the engine rotational speed and waits for the valve timing to be complete, and the flowchart is ended.

In step S205, the engine rotational speed is maintained as a result of fixing the throttle position at the same position when the engine rotational speed reaches n1. Another option is to adjust the throttle position so that the engine rotational speed slightly exceeds n1 (by several dozen rotations, for example).

FIG. 9 shows a timing chart for a case in which the hydraulically-operated phase varying mechanism 2 switches the valve timing of the air intake valves 3 from a valve timing for the fast idling state to a valve timing for the post-warm-up idling state.

During fast idling, when the coolant temperature rises and approaches a preset warm-up completion temperature, the engine rotational speed is changed from the fast idling state to the engine rotational speed of the post-warm-up idling state along with the increase in coolant temperature. As was previously described, when the engine rotational speed decreases and falls below the engine rotational speed threshold n1, the hydraulic pressure in the oil pump also decreases, and it is difficult for the hydraulically-operated phase varying mechanism 2 to switch the phase of the lift center angle of the air intake valves 3 with sufficient responsiveness.

In view of this, the hydraulically-operated phase varying mechanism 2 switches the valve timing of the air intake valves 3 from the valve timing for the fast idling state to the valve timing for the post-warm-up idling state. The switch occurs before the engine rotational speed falls below the engine rotational speed threshold n1 that guarantees the hydraulic pressure needed by the hydraulically-operated phase varying mechanism 2 to switch the valve timing of the air intake valves 3 with high responsiveness. Specifically, when the coolant temperature reaches the specific comparative value $\alpha$ that is lower than the warm-up completion temperature, the phase of the lift center angle of the air intake valves 3 is switched (advanced) to the valve timing phase of the post-warm-up idling state at the end of the fast idling phase, ahead of the timing at which a switch is made from the fast idling state to the post-warm-up idling state.

The phase of the lift center angle of the air intake valves 3 can also be switched while the engine rotational speed is at the level of the fast idling state.

In the present embodiment, the variable valve operating mechanism comprises the hydraulically operated lift/operating angle varying mechanism 1. Therefore, the lift/operating angle varying mechanism 1 also switches the lift/operating angle of the air intake valves 3 at the end of the fast idling phase so that the lift/operating angle of the air intake valves 3 switches from the warm-up idle valve timing to the post-warm-up idle valve timing. The switch occurs ahead of the timing at which a switch is made from fast idling to post-warm-up idling, similar to the hydraulically-operated phase varying mechanism 2 described above.

In the internal combustion engine control apparatus of the present embodiment, the fuel consumption of the internal combustion engine can be improved even if the variable valve operating mechanism is hydraulically operated. This is because valve timing is rapidly switched from the warm-up idle valve timing to the post-warm-up idle valve timing. Also, the extent to which switching from the warm-up idle valve timing to the post-warm-up idle valve timing has an effect on operability (combustion stability) can be greatly reduced because the switch is made at the final phase of fast idling.

In the embodiment described above, the variable valve operating mechanism includes both the hydraulically operated lift/operating angle varying mechanism 1 and the hydraulically operated phase varying mechanism 2. However, the variable valve operating mechanism is not limited to having both the lift/operating angle varying mechanism 1 and the hydraulically-operated phase varying mechanism 2, and can include only one mechanism selected from the lift/operating angle varying mechanism 1 and the hydraulically-operated phase varying mechanism 2.

The following effects of the present invention that can be understood from the above-described embodiment.

In the internal combustion engine control apparatus, a hydraulically operated variable valve operating mechanism capable of varying the valve timing of air intake valves sets the valve timing to the warm-up idle valve timing during the fast idling state when the engine is cold, and sets the valve timing to the post-warm-up idle valve timing during the post-warm-up idling state. The high idling speed during the fast idling state when the engine is cold is set to be higher than the idling speed after warm-up has been completed. The variable valve operating mechanism switches the valve timing of the air intake valves by the variable valve operating mechanism from the warm-up idle valve timing to the post-warm-up idle valve timing before the speed of the internal combustion engine after warm-up is completed falls below a rotational speed that lies between the high idling speed and the post-warm-up idling speed and is a rotational speed that guarantees the hydraulic pressure needed to switch the valve timing with a specific degree of responsiveness.

Since the variable valve operating mechanism is driven so as to switch the valve timing during a fast idling state in which the rotational speed is higher than during a post-warm-up idling state, the engine can be operated at greater hydraulic pressures than when the post-warm-up idling state is in effect. In other words, the valve timing can be rapidly switched from the warm-up idle valve timing to the post-warm-up idle valve timing, and the fuel consumption of the internal combustion engine can be improved. This can be achieved because the variable valve operating mechanism is operated at high operating hydraulic pressures. Also, the extent to which the switching from the warm-up idle valve timing to the post-warm-up idle valve timing has an effect on operability (combustion stability) can be greatly reduced because the switch takes place during the final phase of fast idling.

In the internal combustion engine control apparatus described above, the variable valve operating mechanism is specifically capable of varying the valve timing of air intake valves by advancing the phase of the lift center angle of the air intake valves. Also the warm-up idle valve timing is set so that the phase of the lift center angle is retarded (delayed) relative to the post-warm-up idle valve timing, and the phase of the lift center angle of the air intake valves is advanced from the phase of the lift center angle of the air intake valves during the warm-up idle valve timing to reach the phase of the lift center angle of the air intake valves during the post-warm-up idle valve timing at the end of the fast idling phase, ahead of the timing at which a switch is made from the fast idling state to the post-warm-up idling state.

In the internal combustion engine control apparatus described above, the variable valve operating mechanism specifically comprises a hydraulically operated lift/operating angle varying mechanism capable of controlling the continuous increase and decrease of the lift/operating angle of the air intake valves. The lift/operating angle of the air intake valves is switched over from the lift/operating angle of the air intake valves during the warm-up idle valve timing to the lift/operating angle of the air intake valves during the post-warm-up idle valve timing. This switch is made before the speed of the internal combustion engine after warm-up is completed falls below a rotational speed that lies between the high idling speed and the post-warm-up idling speed and is a rotational speed that guarantees the hydraulic pressure needed to switch the valve timing with a specific degree of responsiveness.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An internal combustion engine control apparatus comprising:

a hydraulically operated variable valve operating mechanism configured to vary a valve timing of air intake valves; and a valve timing control section configured to control the hydraulically operated variable valve operating mechanism to set the valve timing to a warm-up idle valve timing with a high idling speed when engine temperature is determined to be cold and to set the valve timing to a post-warm-up idle valve timing with a post-warm-up idling speed when the engine temperature is determined to be equal to or above a warm-up temperature threshold, the high idling speed being higher than the post-warm-up idling speed, the valve timing control section being further configured to switch the valve timing from the warm-up idle valve timing to the post-warm-up idle valve timing as the engine temperature approaches the warm-up temperature threshold such that the switch starts before an engine rotational speed falls below a rotational speed threshold lying between the high idling speed during the warm-up idle valve timing and the post-warm-up idling speed during the post-warm-up idle valve timing such that a sufficient hydraulic pressure switches the valve timing with a specific degree of responsiveness being attained when the engine rotational speed is at or above the rotational speed threshold.

2. The internal combustion engine control apparatus according to claim 1, wherein the valve timing control section is further configured to set a lift center angle phase of the air intake valves such that a the warm-up lift center angle phase for the warm-up idle valve timing is more retarded than a post-warm-up lift center angle phase for the post-warm-up idle valve timing; and the valve timing control section is further configured to advance the lift center angle phase of the air intake valves such that the post-warm-up lift center angle phase is reached before the post-warm-up idling speed is reached, when switching from the warm-up idle valve timing to the post-warm-up idle valve timing.

3. The internal combustion engine control apparatus according to claim 2, wherein the valve timing control section is further configured to advance the lift center angle phase of the air intake valves such that the post-warm-up lift center angle phase is reached before the rotational speed threshold is reached, when switching from the warm-up idle valve timing to the post-warm-up idle valve timing.

4. The internal combustion engine control apparatus according to claim 2, wherein the variable valve operating mechanism comprises a hydraulically operated lift/operating angle varying mechanism configured to continuous control a valve lift and a valve operating angle of the air intake valves to selectively increase or decrease the valve lift and the valve operating angle of the air intake valves.

5. The internal combustion engine control apparatus according to claim 4, wherein the valve timing control section is further configured to switch the valve lift and the valve operating angle of the air intake valves such that the valve lift and the valve operating angle used for the post-warm-up idle valve timing phase is reached before the post-warm-up idling speed is reached, when switching from the warm-up idle valve timing to the post-warm-up idle valve timing.

6. The internal combustion engine control apparatus according to claim 4, wherein the valve timing control section is further configured to switch the valve lift and the valve operating angle of the air intake valves such that the valve lift and the valve operating angle used for the post-warm-up idle valve timing phase is reached before the rotational speed threshold is reached, when switching from the warm-up idle valve timing to the post-warm-up idle valve timing.

7. The internal combustion engine control apparatus according to claim 1, wherein the valve timing control section is further configured to control the switch from the warm-up idle valve timing to the post-warm-up idle valve timing such that the switching to the post-warm-up idle valve timing finishes at or before the rotational speed threshold.

8. An engine comprising the internal combustion engine control apparatus according to claim 1.

9. An internal combustion engine control apparatus comprising:

hydraulically operated variable valve operating means for varying a valve timing of air intake valves; and valve timing control means for controlling the hydraulically operated variable valve operating means to set the valve timing to a warm-up idle valve timing with a high idling speed when engine temperature is determined to be cold and to set the valve timing to a post-warm-up idle valve timing with a post-warm-up idling speed when the engine temperature is determined to be equal to or above a warm-up temperature threshold, the high idling speed being higher than the post-warm-up idling speed, the valve timing control means further performing switching of the valve timing from the warm-up idle valve timing to the post-warm-up idle valve timing as the engine temperature approaches the warm-up temperature threshold such that the switch starts before an engine rotational speed falls below a rotational speed threshold lying between the high idling speed during the warm-up idle valve timing and the post-warm-up idling speed during the post-warm-up idle valve timing such that a sufficient hydraulic pressure switches the valve timing with a specific degree of responsiveness being attained when the engine rotational speed is at or above the rotational speed threshold.

10. A method for controlling an intake air for an internal combustion engine comprising:

varying a valve timing of air intake valves;

setting the valve timing to a warm-up idle valve timing with a high idling speed when engine temperature is determined to be cold;

setting the valve timing to a post-warm-up idle valve timing with a post-warm-up idling speed when the engine temperature is determined to be equal to or above a warm-up temperature threshold, the high idling speed being higher than the post-warm-up idling speed and switching of the valve timing from the warm-up idle valve timing to the post-warm-up idle valve timing as the engine temperature approaches the warm-up temperature threshold such that the switch starts before an engine rotational speed falls below a rotational speed threshold lying between the high idling speed during the warm-up idle valve timing and the post-warm-up idling speed during the post-warm-up idle valve timing such that a sufficient hydraulic pressure switches the valve timing with a specific degree of responsiveness being attained when the engine rotational speed is at or above the rotational speed threshold.

* * * * *